US009365383B2

(12) United States Patent
Shimosaka

(10) Patent No.: US 9,365,383 B2
(45) Date of Patent: Jun. 14, 2016

(54) FEED ROLLER OF CONVEYING DEVICE

(71) Applicant: PFU Limited, Kahoku-shi, Ishikawa (JP)

(72) Inventor: Kiichiro Shimosaka, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 344 days.

(21) Appl. No.: 14/067,866

(22) Filed: Oct. 30, 2013

(65) Prior Publication Data

US 2014/0179500 A1 Jun. 26, 2014

(30) Foreign Application Priority Data

Dec. 20, 2012 (JP) ..... 2012-278371

(51) Int. Cl.
*B65H 27/00* (2006.01)
*B65H 3/06* (2006.01)

(52) U.S. Cl.
CPC ..... *B65H 27/00* (2013.01); *B65H 3/0638* (2013.01); *B65H 2404/18* (2013.01); *B65H 2601/324* (2013.01)

(58) Field of Classification Search
CPC ..... B65H 5/064; B65H 2404/55; B65H 2404/551; B65H 2404/18; B65H 2601/324; B65H 27/00; B65H 3/0638; B65H 5/06; B65H 5/062; B65H 5/066; B65H 5/068; B65H 19/105; B65H 19/2292; B65H 2402/5153; B65H 2402/5152; B65H 2402/515; B65H 2402/5155; B65H 2404/113; B65H 2404/114; B65H 2404/1141; B65H 51/04; B65H 51/08; B65H 51/10; B65H 51/28; B65H 57/14; B60B 25/002; B60B 25/004; B60B 25/006; B60B 25/008
See application file for complete search history.

(56) References Cited

U.S. PATENT DOCUMENTS 6,550,609 B2 * 4/2003 Coen ..... B65G 39/04 193/37
2014/0179500 A1 6/2014 Shimosaka

FOREIGN PATENT DOCUMENTS

| | | | |
|---|---|---|---|
| CN | 203714940 | U | 7/2014 |
| JP | 11-116078 | A | 4/1999 |
| JP | 11-286340 | A | 10/1999 |
| JP | 2003-089442 | A | 3/2003 |
| JP | 2005-015095 | A | 1/2005 |

OTHER PUBLICATIONS

Office Action Chinese Patent Application No. 201310654072.3 dated Sep. 6, 2015.

* cited by examiner

*Primary Examiner* — Jason L Vaughan
(74) *Attorney, Agent, or Firm* — McDermott Will & Emery LLP

(57) ABSTRACT

A pick roller as a feed roller of a conveying device includes an inner core portion rotatably disposed on a rotational shaft, a rubber in contact with a sheet, and an outer core portion on which the rubber is mounted and that is removably mounted on the outside of the inner core portion. This enables replacement of the rubber and the outer core portion as one body, making replacement of the rubber easy without improper mounting.

3 Claims, 8 Drawing Sheets

FEED ROLLER OF CONVEYING DEVICE

CROSS-REFERENCE TO RELATED APPLICATION(S)

This application is based on and claims the benefit of priority from Japanese Patent Application No. 2012-278371, filed on Dec. 20, 2012, the entire contents of which are incorporated herein by reference.

BACKGROUND OF THE INVENTION

1. Field of the Invention

The present invention relates to a feed roller of a conveying device.

2. Description of the Related Art

Many image reading apparatuses that read and electrically process an image of a document and printing apparatuses that print an image now include a conveying device that conveys a sheet such as a document to be read or paper on which an image is printed. Such a conveying device includes a roller having a rubber attached to its surface in contact with the sheet, the roller rotating to convey the sheet. Such a roller can degrade its conveying performance because of a reduced friction force of the rubber as a result of repeated sheet conveying operations. Some rollers are thus configured so as to permit easy replacement of the rubber with the aim of achieving conveyance accuracy (see, for example, Japanese Patent Application Laid-open No. 2005-15095, Japanese Patent Application Laid-open No. 2003-89442, and Japanese Patent Application Laid-open No. 11-286340).

When a user of the conveying device replaces the rubber of the roller with a new one, however, he or she may not be able to replace the rubber appropriately, having the rubber distorted, cracked, or damaged during installation. When the surface of a core on which the rubber is attached is contaminated, even if the rubber itself does not have a defect, the rubber slips over the core, and resultant insufficient torque during conveyance may result in a conveyance fault.

SUMMARY OF THE INVENTION

The present invention is directed to a feed roller of a conveying device that eliminates the conveyance fault.

One aspect of the present invention relates to a feed roller of a conveying device. The feed roller includes an inner core portion disposed rotatably on a rotational shaft, a rubber in contact with a conveyed object, and an outer core portion on which the rubber is mounted and that is removably mounted on the outside of the inner core portion.

DETAILED DESCRIPTION OF THE PREFERRED EMBODIMENTS

A feed roller of a conveying device according to an embodiment of the present invention will be described below with reference to the accompanying drawings. It is noted that the embodiment is not intended to limit the present invention. The elements in the embodiment to be described below include those substitutable or easy in substitutability by those skilled in the art or those substantially identical.

Embodiment

Figure 1:
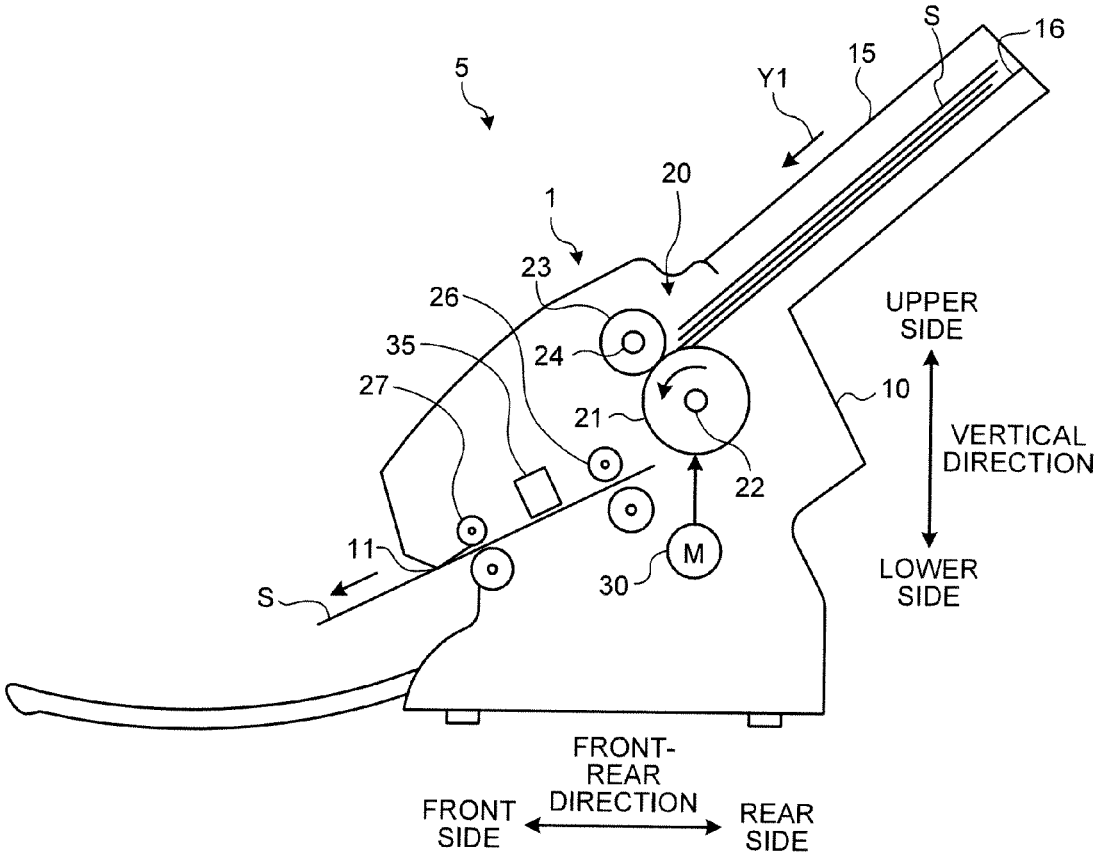
FIG. 1 is a schematic view illustrating a conveying device including a feed roller of a conveying device according to an embodiment of the present invention.

FIG. 1 is a schematic view illustrating a conveying device including a feed roller of a conveying device according to the embodiment of the present invention. This conveying device 1 illustrated in FIG. 1 is configured to separate one sheet S from a stack of a plurality of sheets S as conveyed objects and convey the sheet S. The conveying device 1 is applied to an automatic sheet feeding mechanism mounted on an image reading apparatus such as a scanner or a facsimile, and an image forming apparatus such as a printer. The embodiment will be described for an exemplary image reading apparatus 5 on which the conveying device 1 is mounted. In the embodiment, therefore, the sheets S as the conveyed objects include sheet-like objects to be read, such as documents and business cards.

The image reading apparatus 5 includes a tray 15 and a separating mechanism 20. The tray 15 is provided as a conveyed object loading base that houses therein a stack of a plurality of sheets S and includes a placement surface 16 that faces upwardly. The placement surface 16 of the tray 15 is inclined upwardly toward the rear and can hold a stack of sheets S.

The separating mechanism 20 is disposed inside a housing 10 of the image reading apparatus 5 at a position downstream of the placement surface 16 in the conveying direction Y1 of the sheets S. The separating mechanism 20 separates, from the sheets S stacked on the placement surface 16, one sheet at a time and conveys the sheet. Specifically, the separating mechanism 20 includes a pick roller 21 as a feed roller that feeds the separated sheet S and a brake roller 23 that stops the sheets S other than the separated sheet S to be fed by the pick roller 21.

The pick roller 21 and the brake roller 23 are disposed so as to face each other on respective sides in the thickness direction of the sheets S across a conveying path of the sheets S. For example, the pick roller 21 is disposed below a surface extending from the placement surface 16, and the brake roller 23 is disposed above the surface extending from the placement surface 16 and is opposite to the pick roller 21. While rotational shafts 22 and 24 extend in the width direction of the placement surface 16, the pick roller 21 and the brake roller 23 are arranged so as to be rotatable about the rotational shafts 22 and 24, respectively.

The housing 10 houses therein a drive unit 30 that includes a drive power source such as an electric motor, and a power transmission mechanism such as a gear. The pick roller 21 and the brake roller 23 are rotatable by power transmitted from the drive unit 30. Specifically, the pick roller 21 has an outer peripheral surface adjacent to the conveying path of the sheet S rotating about the rotational shaft 22 in the conveying direction Y1. The brake roller 23 has an outer peripheral surface adjacent to the conveying path of the sheet S rotating about the rotational shaft 24 in a direction opposite to the conveying direction Y1.

The housing 10 houses therein a conveying roller 26 disposed downstream of the separating mechanism 20 in the conveying direction Y1 of the sheet S. The housing 10 further houses therein a discharging roller 27 disposed downstream of the conveying roller 26 in the conveying direction Y1 and near a discharging port 11 for the sheet S.

The housing 10 houses therein an image reading unit 35 disposed between the conveying roller 26 and the discharging roller 27 in the conveying direction Y1 of the sheet S. The image reading unit 35 reads an image on the sheet S being conveyed. This enables the image reading apparatus 5 to read the image on the sheet S conveyed inside the housing 10.

Figure 2:
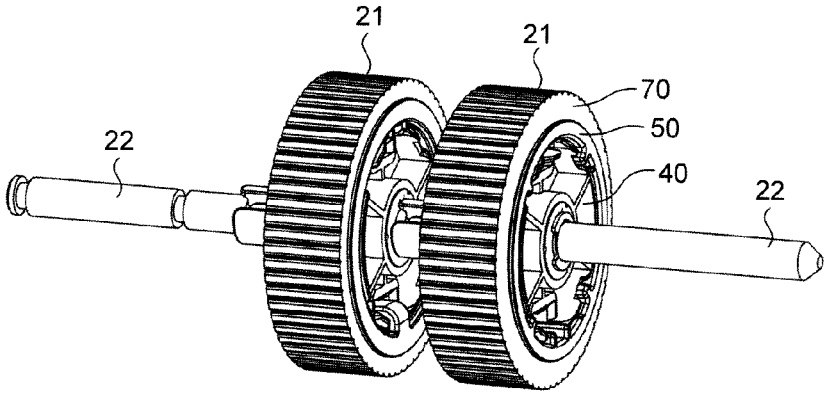
FIG. 2 is a perspective view illustrating pick rollers illustrated in FIG. 1.
Figure 3:
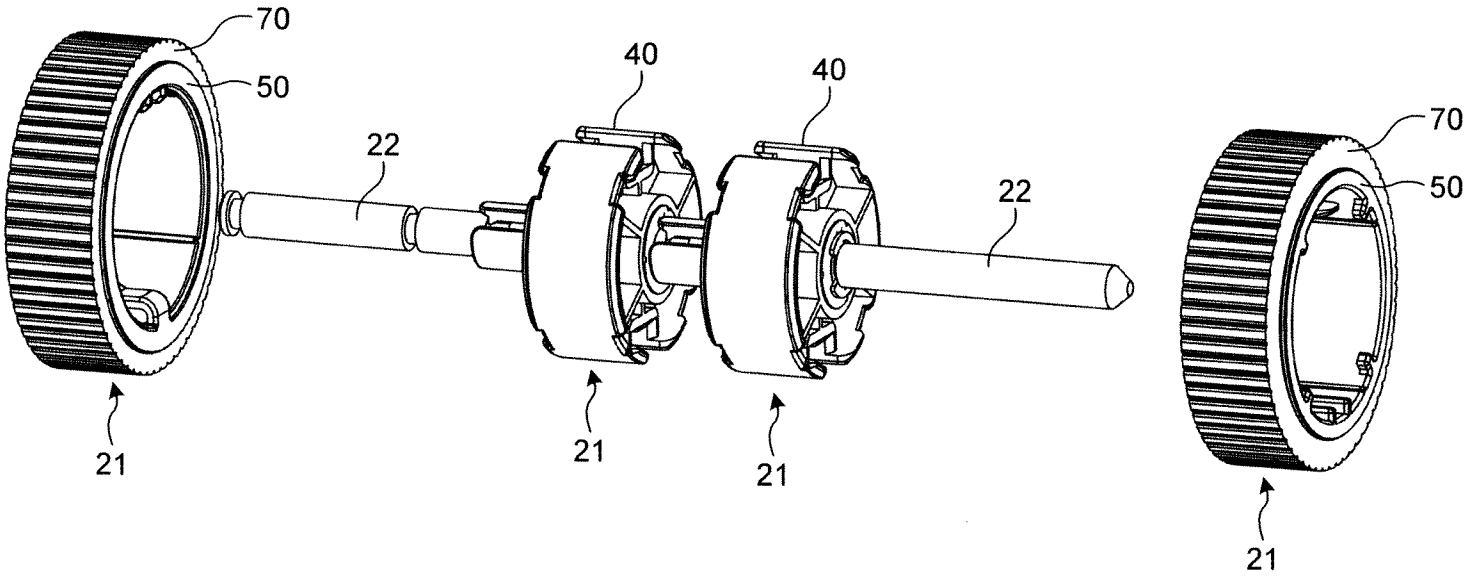
FIG. 3 is a perspective view illustrating outer core portions removed from inner core portions illustrated in FIG. 2.

FIG. 2 is a perspective view illustrating the pick rollers illustrated in FIG. 1. FIG. 3 is a perspective view illustrating outer core portions removed from inner core portions illustrated in FIG. 2. Two pick rollers 21, each having substantially identical diameter and identical width, are mounted on the same rotational shaft 22. These pick rollers 21 are rotatable about the rotational shaft 22 only in one direction because of the function of a one-way clutch mechanism (not illustrated). As a result, the pick rollers 21 have their surfaces adjacent to the conveying path of the sheet S rotatable only in the conveying direction Y1. A rubber 70 is mounted on each of the outer peripheral surfaces of the pick rollers 21 in contact with the sheet S. Specifically, the rubber 70 is disposed so as to be in contact with the sheet S during the conveyance of the sheet S.

Each of the pick rollers 21 includes an inner core portion 40 and an outer core portion 50 that form a core portion separable into two. The inner core portion 40 is formed to have an outline that is a substantially cylindrical shape. The inner core portion 40 is disposed rotatably on the rotational shaft 22 in such a position that the cylinder has its axis aligned with the axis of the rotational shaft 22. Specifically, the inner core portion 40 is mounted on the rotational shaft 22 via the one-way clutch mechanism.

The outer core portion 50 has an inside diameter substantially equal to the outside diameter of the inner core portion 40. The outer core portion 50 is formed substantially into an annular ring, having an axial width substantially equal to the width of the inner core portion 40. The outer core portion 50 having the above-described shape is attached to the outer peripheral surface of the inner core portion 40. The rubber 70 has an inside diameter substantially equal to the outside diameter of the outer core portion 50. The rubber 70 is formed substantially into an annular ring, having an axial width substantially equal to the width of the outer core portion 50. The rubber 70 is attached to the outer peripheral surface of the outer core portion 50.

The outer core portion 50 is removable from the inner core portion 40. Specifically, the outer core portion 50 is removably attached to the outside of the inner core portion 40. Each of the two pick rollers 21 mounted on the same rotational shaft 22 has an arrangement identical to each other. The outer core portion 50 mounted with the rubber 70 is removably attached to the outside of the inner core portion 40 disposed rotatably on the rotational shaft 22.

Figure 4:
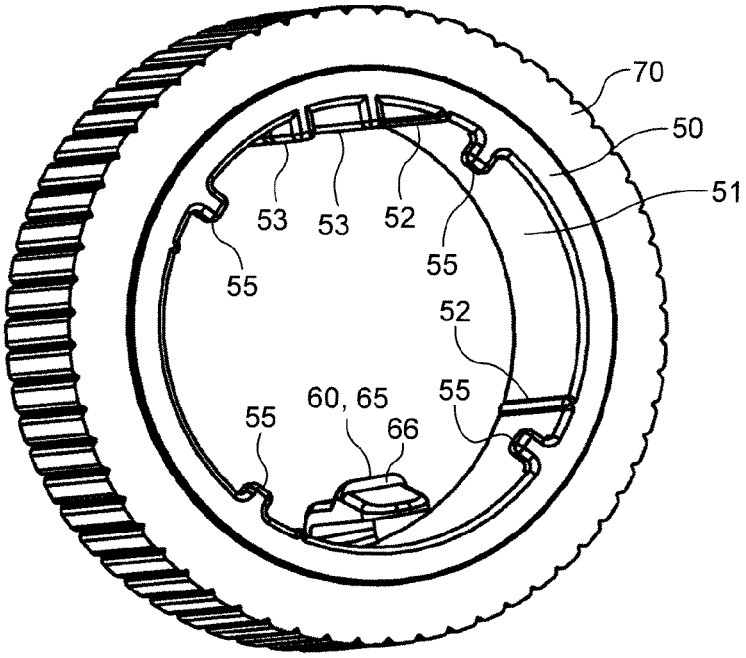
FIG. 4 is a perspective view illustrating the outer core portion illustrated in FIG. 2.
Figure 5:
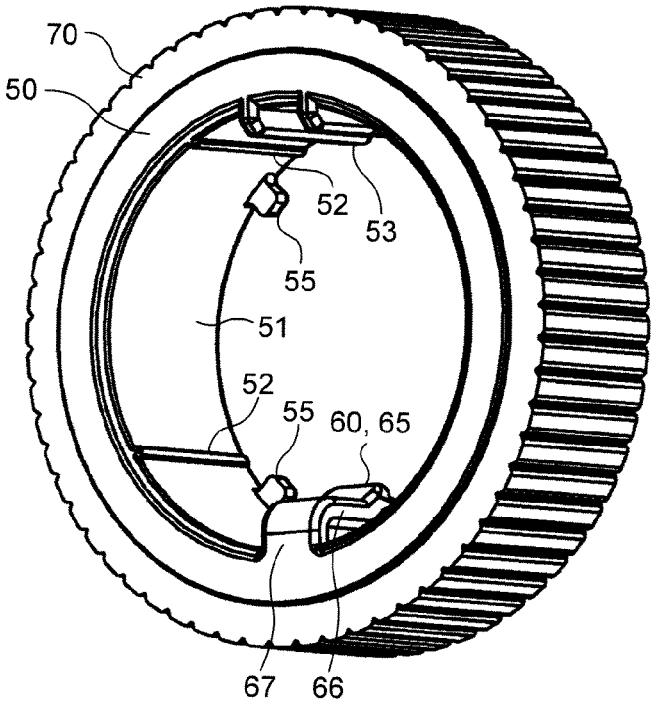
FIG. 5 is a perspective view illustrating the outer core portion illustrated in FIG. 4 viewed from a different direction.
Figure 6:
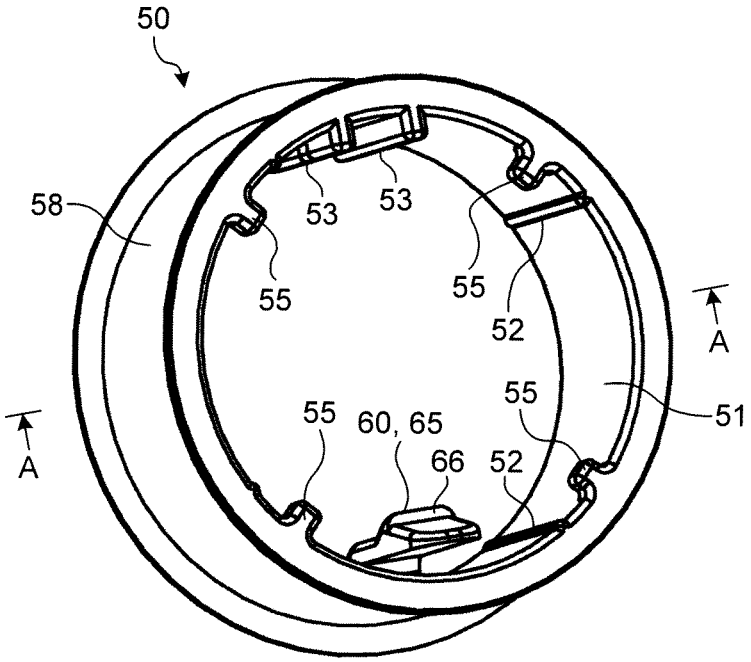
FIG. 6 is a perspective view illustrating the outer core portion illustrated in FIG. 4 from which a rubber is removed.

FIG. 4 is a perspective view illustrating the outer core portion illustrated in FIG. 2. FIG. 5 is a perspective view illustrating the outer core portion illustrated in FIG. 4 viewed from a different direction. FIG. 6 is a perspective view illustrating the outer core portion illustrated in FIG. 4 from which the rubber is removed. The outer core portion 50 and the inner core portion 40 have a pair of tab portions 60 that are engaged with each other when the outer core portion 50 and the inner core portion 40 are in a predetermined fit condition. The outer core portion 50 has an outer tab portion 65 disposed on an inner peripheral surface 51 thereof, the outer tab portion 65 constituting the pair of tab portions 60. The outer tab portion 65 is formed so as to be engageable in the axial direction with the tab portion 60 on the inner core portion 40 side. The outer tab portion 65 is disposed so as to be elastically deformable in the radial direction of the outer core portion 50.

Specifically, the outer tab portion 65 includes an engaging portion 66 that engages with the tab portion 60 on the inner core portion 40 side. The engaging portion 66 is separated from the inner peripheral surface 51 inwardly in the radial direction. One end of the engaging portion 66 in the axial direction of the outer tab portion 65 is connected to the inner peripheral surface 51 by a support portion 67 of the outer tab portion 65. The support portion 67 elastically supports the engaging portion 66 so that the engaging portion 66 can move in a direction in which a distance between the engaging portion 66 and the inner peripheral surface 51 varies in the radial direction of the outer core portion 50. This allows the outer tab portion 65 to elastically deform in the radial direction of the outer core portion 50.

The outer core portion 50 has a key 53 on its inner peripheral surface 51. The key 53 restricts rotation of the outer core portion 50 relative to the inner core portion 40 when the outer core portion 50 is mounted on the inner core portion 40. The key 53 is disposed point-symmetrically relative to the outer tab portion 65 on the inner peripheral surface 51 of the outer core portion 50. Specifically, the key 53 is disposed at a point 180° apart from the position at which the outer tab portion 65 is disposed with respect to the axis of the outer core portion 50, on the inner peripheral surface 51 of the outer core portion 50.

The key 53 protrudes inwardly in the radial direction of the inner peripheral surface 51. The key 53 is formed to extend from a first end side to a second end side of the inner peripheral surface 51 in the axial direction of the outer core portion 50. In addition, the key 53 has a central portion, not protruding from the inner peripheral surface 51, in the circumferential direction of the inner peripheral surface 51. In other words, the key 53 includes two protrusions protruding from the inner peripheral surface 51 and separated from each other in the circumferential direction of the inner peripheral surface 51. Having such arrangements, the key 53 has an overall width in the circumferential direction of the inner peripheral surface 51, which is the distance between the surfaces of the two protrusions opposite to their facing surfaces, wider than the width of the outer tab portion 65 in the same direction.

Figure 7:
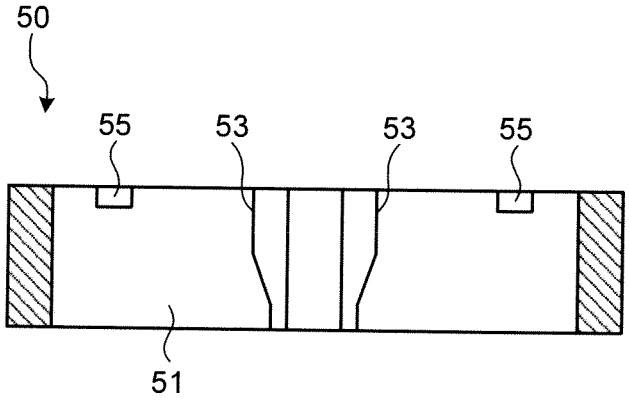
FIG. 7 is a cross-sectional view taken along line A-A of FIG. 6.

FIG. 7 is a cross-sectional view taken along line A-A of FIG. 6. The key 53 has the overall width in the circumferential direction of the inner peripheral surface 51, with the overall width varying with positions in the axial direction of the outer core portion 50. Specifically, the overall width on a first end side in the axial direction of the outer core portion 50 is wider than that on a second end side in the axial direction of the outer core portion 50. Specifically, the overall width of the key 53 is larger on an end side on which an assembly restricting protrusion 55 to be described later is disposed, of the two ends of the key 53 in the axial direction of the outer core portion 50, than the overall width on the other end side. The overall width of the key 53 varies between the two ends.

The outer core portion 50 has protrusions 52 at four places in the circumferential direction on its inner peripheral surface 51. The protrusions 52 contact the inner core portion 40 when the outer core portion 50 is mounted on the outside of the inner core portion 40. Similarly to the key 53, each of the protrusions 52 protrudes inwardly from the inner peripheral surface 51 in the radial direction and is formed to extend from the first end side to the second end side of the inner peripheral surface 51 in the axial direction of the outer core portion 50. The protrusions 52, however, protrude from the inner peripheral surface 51 by an amount substantially smaller than the key 53 does. The four protrusions 52 are disposed at two places on both sides of the outer tab portion 65 and at another two places on both sides of the key 53 in the circumferential direction of the inner peripheral surface 51.

The outer core portion 50 has the assembly restricting protrusions 55 disposed on one end side in the axial direction on its inner peripheral surface 51. The assembly restricting protrusions 55 protrude inwardly from the inner peripheral surface 51 in the radial direction as with the protrusions 52; however, unlike the protrusions 52, the assembly restricting protrusions 55 are formed to be thin in their axial width. Specifically, the assembly restricting protrusions 55 are disposed, out of the two ends in the axial direction of the inner peripheral surface 51, on the end side opposite to the side on which the support portion 67 of the outer tab portion 65 is disposed. Similarly to the protrusions 52, the assembly restricting protrusions 55 are disposed at four places in the circumferential direction. That is, the assembly restricting protrusions 55 are disposed at two places on both sides of the outer tab portion 65 and at another two places on both sides of the key 53 in the circumferential direction of the inner peripheral surface 51.

The two pick rollers 21 are mounted on the same rotational shaft 22 so that the side of the assembly restricting protrusions 55 of one pick roller 21 faces a side opposite to the side of the assembly restricting protrusions 55 of the other pick roller 21.

The rubber 70 is mounted on an outer peripheral surface 58 of the outer core portion 50 formed as described above. Specifically, the rubber 70 is formed substantially into an annular ring. The rubber 70, when not mounted on the outer core portion 50, has an inside diameter slightly smaller than the outside diameter of the outer peripheral surface 58 of the outer core portion 50. Thus, the rubber 70 is mounted on the outer peripheral surface 58 of the outer core portion 50, by being fitted thereon through an elastic force of the rubber 70.

The rubber 70 has a plurality of grooves on its outer peripheral surface. The grooves extend in the axial direction of the outer core portion 50 and are in juxtaposition with each other in the circumferential direction of the outer core portion 50. The rubber 70 thus has the outer peripheral surface that is irregular in the circumferential direction.

Figure 8:
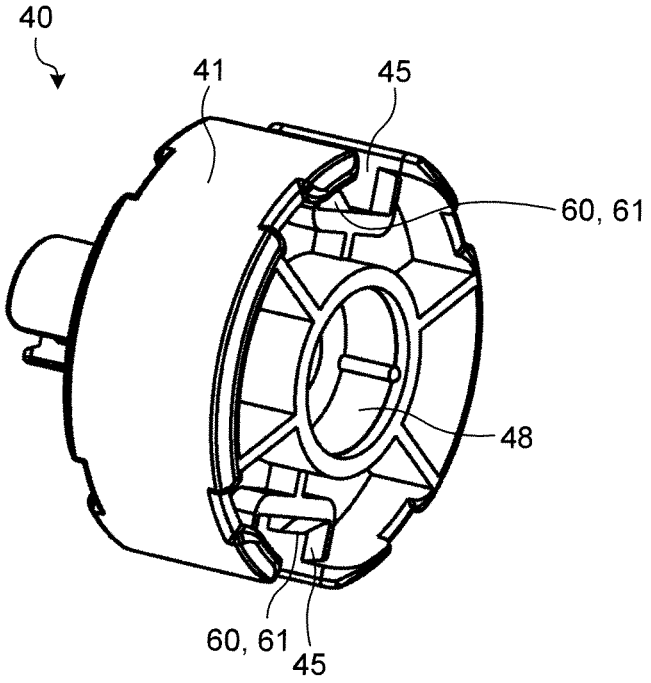
FIG. 8 is a perspective view illustrating the inner core portion illustrated in FIG. 2.
Figure 9:
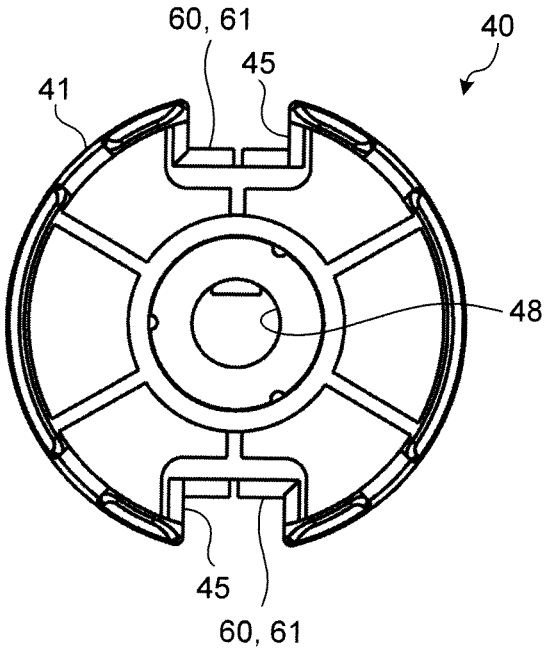
FIG. 9 is a front view illustrating the inner core portion illustrated in FIG. 8.

FIG. 8 is a perspective view illustrating the inner core portion illustrated in FIG. 2. FIG. 9 is a front elevational view illustrating the inner core portion illustrated in FIG. 8. The inner core portion 40 has an outer peripheral surface 41 that has a groove 45 formed therein, in which the key 53 of the outer core portion 50 fits. The groove 45 has a width in the circumferential direction of the inner core portion 40 that is similar to and slightly wider than the overall width of the key 53 in the same direction. Specifically, the groove 45 is formed to have a width similar to and slightly wider than the widest portion of the overall width of the key 53, out of the overall width of the key 53 that varies with positions in the axial direction of the outer core portion 50. The key 53 can thereby fit into the groove 45.

The grooves 45 having such arrangements are formed at two point-symmetrical positions about the axis of the inner core portion 40, in the outer peripheral surface 41 of the inner core portion 40. That is, the grooves 45 at two positions are disposed 180° apart from each other with respect to the axis of the inner core portion 40, in the outer peripheral surface 41 of the inner core portion 40.

The inner core portion 40 has an inner tab portion 61 that engages with the outer tab portion 65 of the outer core portion 50 when the outer core portion 50 and the inner core portion 40 are in a predetermined fit condition. That is, the inner tab portion 61 constitutes, together with the outer tab portion 65, the pair of tab portions 60 that are engaged with each other when the outer core portion 50 and the inner core portion 40 are in a predetermined fit condition.

The inner tab portion 61 having the arrangements as described above is disposed in each groove 45. As noted earlier, because the grooves 45 are formed at two places in the outer peripheral surface 41 of the inner core portion 40, inner tab portions 61 are formed at two places, similarly to the grooves 45. Each of the grooves 45 at two places has the corresponding inner tab portion 61. That is, each of the two grooves 45 formed in the outer peripheral surface 41 of the inner core portion 40 has the corresponding inner tab portion 61, and the two grooves 45 are formed in an identical shape.

The inner tab portion 61 formed in the groove 45 protrudes from a bottom thereof. The inner tab portion 61 is formed to engage, in the axial direction, with the engaging portion 66 of the outer tab portion 65, by abutting each other's surfaces facing in the axial direction. Specifically, the inner tab portion 61 and the outer tab portion 65, when in engagement with each other, allow the outer core portion 50 mounted on the inner core portion 40 to be restricted from axially moving to the end side, on which the assembly restricting protrusions 55 are disposed.

In other words, the abutting surfaces of the inner tab portion 61 and the outer tab portion 65 in engagement with each other are arranged such that the abutting surface of the inner tab portion 61 abuts against the abutting surface of the outer tab portion 65 from the side on which the assembly restricting protrusions 55 are disposed. When the inner tab portion 61 and the outer tab portion 65 are engaged with each other, the inner tab portion 61 restricts the outer tab portion 65 from moving toward the place where the assembly restricting protrusions 55 are disposed.

When the inner tab portion 61 and the outer tab portion 65 that are disengaged are to be engaged, or when the inner tab portion 61 and the outer tab portion 65 that are engaged are to be disengaged, elastic deformation of the outer tab portion 65 enables the inner tab portion 61 and the outer tab portion 65 to be engaged or disengaged, respectively. To be specific, since the engaging portion 66 of the outer tab portion 65 is moved outwardly in the radial direction of the outer core portion 50 through the elastic deformation of the outer tab portion 65, the outer tab portion 65 can be engaged with or disengaged from the inner tab portion 61.

The inner core portion 40 having the arrangements as described above includes a fit portion 48 formed around its axis, the fit portion 48 being fitted onto the rotational shaft 22. The fit portion 48 is fitted onto the rotational shaft 22 via the one-way clutch mechanism, so that the inner core portion 40 is mounted on the rotational shaft 22.

The pick roller 21 of the conveying device 1 according to the embodiment of the present invention is arranged as described heretofore. Operation of the conveying device 1 will be described below. To read images of the sheets S with the image reading apparatus 5 in which the conveying device 1 is mounted, reading is started, with the sheets S from which the images are read being placed on the tray 15. When the image reading apparatus 5 starts reading the image, the drive unit 30 is driven, and power generated at the drive unit 30 is transmitted to rotate the pick rollers 21. This rotates the pick rollers 21. The pick rollers 21 are disposed at positions at which the pick rollers 21 contact the sheets S placed on the tray 15 from the lower surface side of the sheets S. Thus, the sheets S are sent out in the conveying direction Y1 by a friction force between the sheets S and the rubbers 70 of the rotating pick rollers 21.

To convey a sheet S, a driving force generated by the drive unit 30 also causes the brake roller 23 to rotate. The brake roller 23 contacts the sheets S from the upper surface side of the sheets S. The rotating direction of the brake roller 23 at a portion in contact with the sheets S is opposite to the conveying direction Y1 of the sheets S, so that the sheets S placed on top of the sheet S in contact with the pick rollers 21 are pushed backward toward the tray 15 side. Thus, the separating mechanism 20 separates one sheet from the sheets S stacked on the placement surface 16 of the tray 15 and feeds the sheet in the conveying direction Y1.

The sheet S separated by the separating mechanism 20 and fed off from the tray 15 is conveyed by the conveying roller 26 in the conveying direction Y1. The image reading unit 35, which is disposed downstream of the conveying roller 26 in the conveying direction Y1 reads the image of the sheet S being conveyed by the conveying roller 26. When the image of the sheet S has been read by the image reading unit 35, the sheet S is conveyed in the conveying direction Y1 by the discharging roller 27, which is disposed downstream of the image reading unit 35 in the conveying direction Y1.

The sheet S from which the image has been read is thereby discharged from the discharging port 11. The sheet S placed at the bottom in the sheets S stacked on the tray 15 is consecutively conveyed, and the image is read from that sheet S. The image reading apparatus 5 in which the conveying device 1 is mounted repeats the foregoing operations to convey the sheets S stacked on the tray 15 in sequence and read the images in sequence from the sheets S stacked in layers.

When the conveying device 1 conveys the sheet S, the rubber 70 of the pick roller 21 is in contact with the sheet S. Due to wear or contamination on the rubber 70 of the pick roller 21, therefore, the friction force with the sheet S may be reduced. In such cases, by removing the outer core portion 50 to which the rubber 70 is attached from the inner core portion 40, the rubber 70 together with the outer core portion 50 can be replaced with new ones. Removal of the outer core portion 50 from the inner core portion 40 and mounting of the outer core portion 50 on the inner core portion 40 will be described below.

Figure 10:
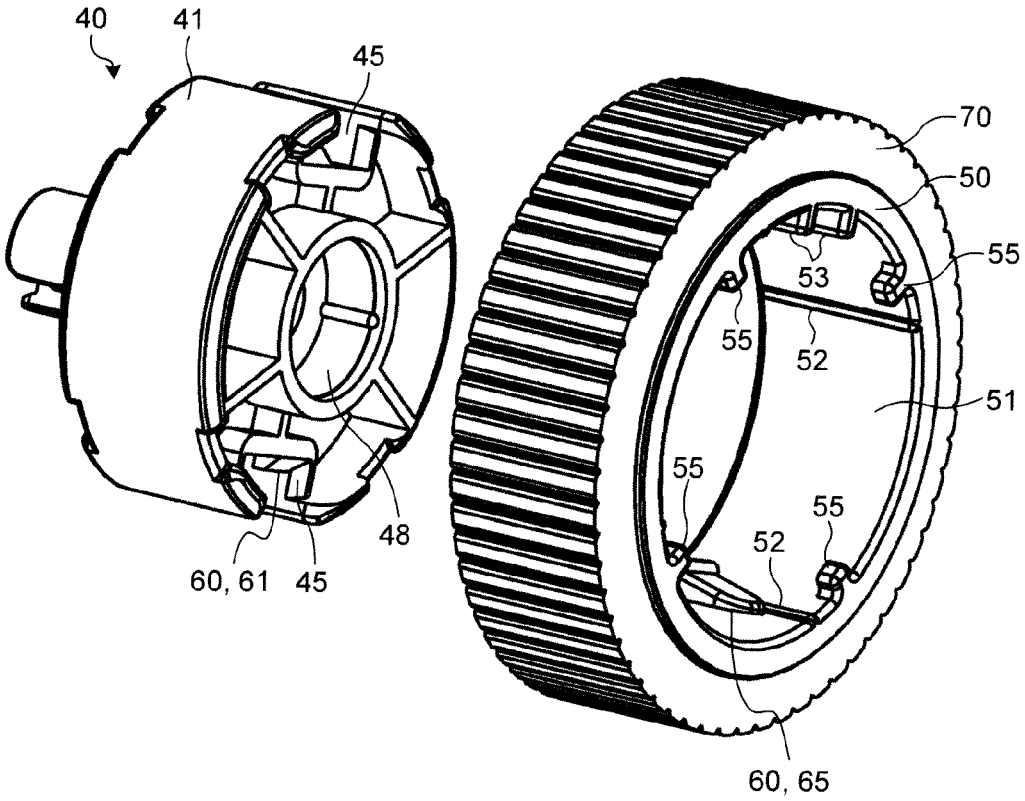
FIG. 10 is a perspective view illustrating the outer core portion to be mounted onto the inner core portion.
Figure 11:
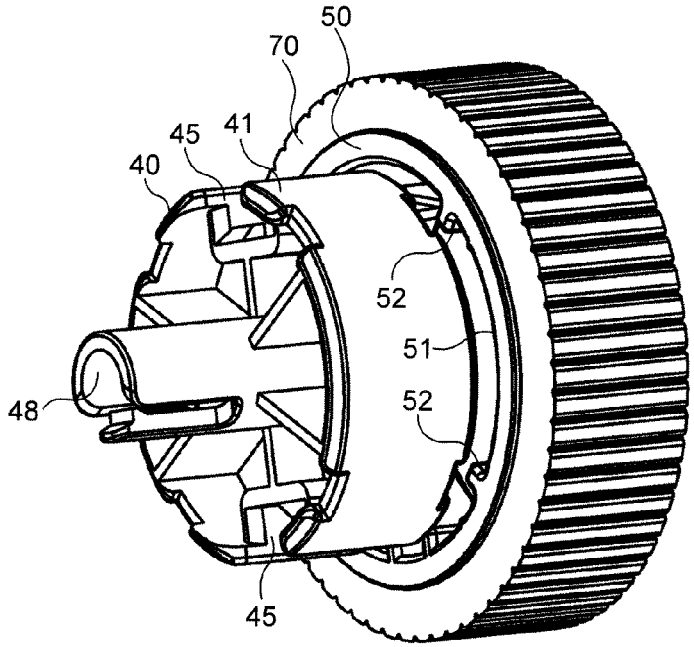
FIG. 11 is a perspective view illustrating a condition in which the outer core portion is to be mounted onto the inner core portion as viewed from a direction different from that of FIG. 10.

FIG. 10 is a perspective view illustrating the outer core portion to be mounted onto the inner core portion. FIG. 11 is a perspective view illustrating a condition in which the outer core portion is to be mounted onto the inner core portion as viewed from a direction different from that of FIG. 10. When the outer core portion 50 having the rubber 70 mounted on the outer peripheral surface 58 is mounted on the inner core portion 40, the outer core portion 50 opposes to the inner core portion 40 a surface opposite to a surface on the side on which the assembly restricting protrusions 55 are disposed. In other words, the outer core portion 50 is mounted on the inner core portion 40 from a side opposite to a side on which the other pick roller 21 mounted on the same rotational shaft 22 is placed, specifically, from the outer side.

With the axis of the inner core portion 40 substantially aligned with the axis of the outer core portion 50, the outer core portion 50 is positioned relative to the inner core portion 40 at such a relative angle in the circumferential direction that the key 53 and the outer tab portion 65 of the outer core portion 50 are substantially aligned with the two grooves 45 in the inner core portion 40. In other words, the outer core portion 50 is set at an angle in the circumferential direction relative to the inner core portion 40 so that the key 53 is aligned with one of the grooves 45 in the inner core portion 40 and the outer tab portion 65 is aligned with the other of the grooves 45 in the inner core portion 40.

Under the foregoing condition, an axial distance between the outer core portion 50 and the inner core portion 40 is reduced, and the outer peripheral surface 41 of the inner core portion 40 is covered by the outer core portion 50. Alternatively, the inner core portion 40 is made to slip into the inner peripheral surface 51 of the outer core portion 50. Because the assembly restricting protrusions 55 of the outer core portion 50 are disposed on the side opposite to the side on which the inner core portion 40 is located, the outer core portion 50 can be placed over the outer peripheral surface 41 of the inner core portion 40, without the inner core portion 40 being brought into contact with the assembly restricting protrusions 55 and restricted from moving.

When the outer core portion 50 is placed over the outer peripheral surface 41 of the inner core portion 40, the outer core portion 50 has the plurality of protrusions 52 formed on the inner peripheral surface 51 that are in contact with the outer peripheral surface 41 of the inner core portion 40. Thus, the outer core portion 50 is mounted on the inner core portion 40 with a small contact area interposed therebetween. This reduces a friction force between the inner peripheral surface 51 of the outer core portion 50 and the outer peripheral surface 41 of the inner core portion 40, so that the outer core portion 50 and the inner core portion 40 can be moved easily relative to each other in the axial direction.

When the outer core portion 50 is placed over the inner core portion 40 as described above, the key 53 fits into one of the grooves 45 in the inner core portion 40, and the outer tab portion 65 fits into the other of the grooves 45 in the inner core portion 40. A condition in which the key 53 fits into the groove 45 will be described below. The key 53 has a wider overall width on the side, on which the assembly restricting protrusions 55 are disposed in the axial direction of the outer core portion 50, than an overall width on the side opposite thereto.

Accordingly, the key 53 is easy to fit into the groove 45. As the outer core portion 50 covers more of the inner core portion 40, to be specific, as the inner core portion 40 advances further into the inside of the outer core portion 50, a gap between the key 53 and the groove 45 in the circumferential direction becomes smaller. As a result, in the beginnings of the key 53 fitting into the groove 45, the key 53 is easier to fit into the groove 45; in last stages of mounting the outer core portion 50 on the inner core portion 40, the distance between the key 53 and the groove 45 in the circumferential direction is smaller, so that the key 53 fits in the groove 45.

Engagement between the inner tab portion 61 and the outer tab portion 65 will be described. The outer tab portion 65 has a narrower width of the outer core portion 50 in the circumferential direction than a width of the groove 45 in the same direction, so that the outer tab portion 65 easily fits into the groove 45. The inner tab portion 61 is formed at the bottom of the groove 45. Thus, the outer tab portion 65 engages with the inner tab portion 61 while being fitted in the groove 45.

When the outer tab portion 65 is about to engage with the inner tab portion 61, the engaging portion 66 of the outer tab portion 65 comes into contact with the inner tab portion 61 since the amount of the outer core portion 50 that covers the inner core portion 40 increases. When the outer core portion 50 is moved under this condition in a direction to mount the outer core portion 50 on the inner core portion 40, a force acting in this moving direction is applied to the outer tab portion 65 as an outward force in the radial direction of the outer core portion 50. The outer tab portion 65, having received this force, is elastically deformed, which deforms the engaging portion 66 in a direction to move the engaging portion 66 outwardly in the radial direction.

When the outer core portion 50 is further moved under this condition and when the abutting surface of the outer tab portion 65 in engagement with the inner tab portion 61 exceeds a position of the abutting surface on the inner tab portion 61 side during the engagement, the outer tab portion 65 and the inner tab portion 61 are released from the contact condition in the radial direction of the outer core portion 50.

Figure 12:
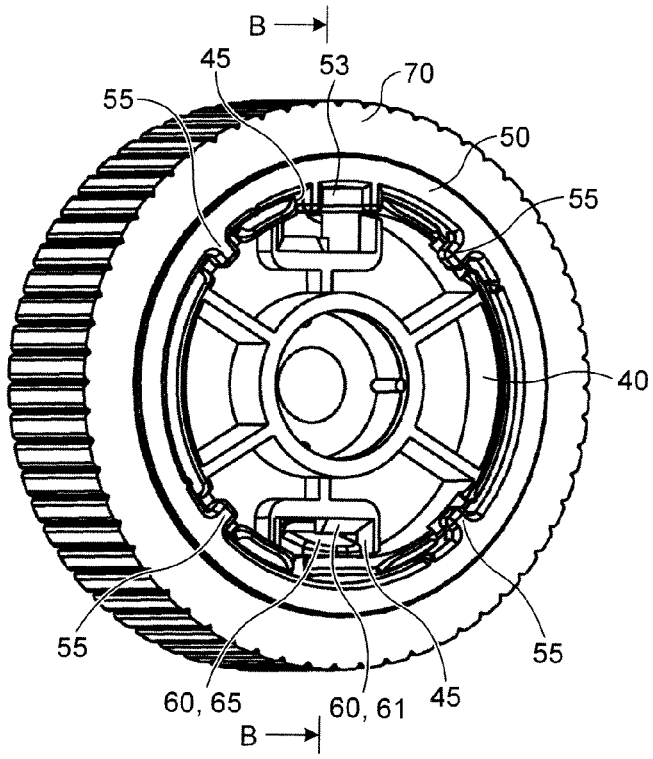
FIG. 12 is a perspective view illustrating a condition in which the outer core portion has been mounted onto the inner core portion.
Figure 13:
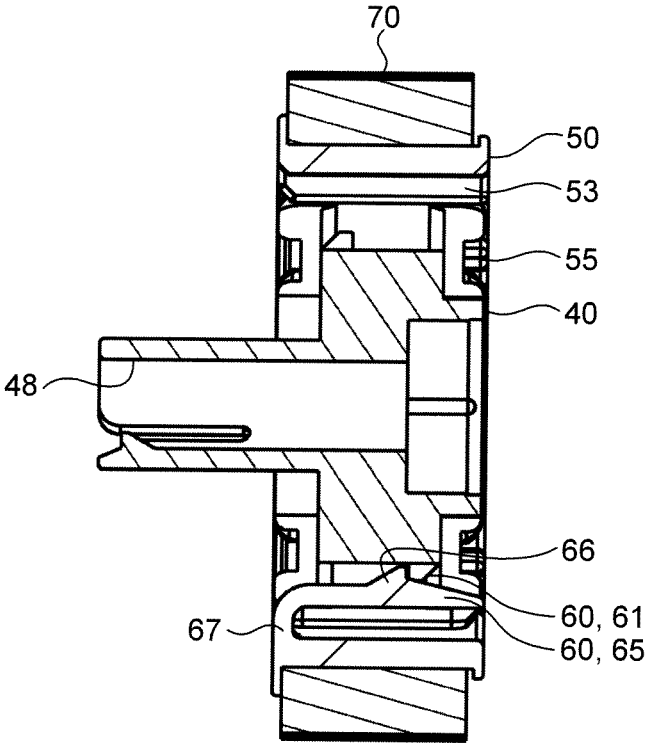
FIG. 13 is a cross-sectional view taken along line B-B of FIG. 12.

FIG. 12 is a perspective view illustrating a condition in which the outer core portion has been mounted onto the inner core portion. FIG. 13 is a cross-sectional view taken along line B-B of FIG. 12. When the outer tab portion 65 and the inner tab portion 61 are released from the contact condition in the radial direction, the force acting outwardly in the radial direction on the outer tab portion 65 is removed. As a result, the outer tab portion 65 in the elastically deformed condition is then returned to its original condition, so that the engaging portion 66 moves inwardly in the radial direction. The abutting surface of the outer tab portion 65 in engagement with the inner tab portion 61, with the engaging portion 66 moved radially inwardly, faces the abutting surface of the inner tab portion 61 in engagement with the outer tab portion 65. This results in the two abutting surfaces abutting against each other and the outer tab portion 65 engaging with the inner tab portion 61.

The outer tab portion 65 and the inner tab portion 61 are engaged with each other when the outer core portion 50 and the inner core portion 40 are in a predetermined fit condition, in other words, when the outer core portion 50 is mounted on the inner core portion 40 so as to place the pick roller 21 in a use condition. When the outer tab portion 65 and the inner tab portion 61 are engaged with each other as described above, the outer tab portion 65 is restricted by the inner tab portion 61 from moving in a direction toward the assembly restricting protrusions 55. Thus, the outer core portion 50 is restricted from moving in this direction.

Meanwhile, when the outer core portion 50 and the inner core portion 40 are in the predetermined fit condition, the assembly restricting protrusions 55 of the outer core portion 50 contact the inner core portion 40. As a result, the outer core portion 50 is restricted from moving relative to the inner core portion 40 in a direction opposite to a direction toward the assembly restricting protrusions 55 side in the axial direction.

Because of the foregoing arrangements, the outer core portion 50 and the inner core portion 40 are restricted from relatively moving in the axial direction by the tab portions 60 and the assembly restricting protrusions 55. In addition, under the foregoing condition, the insertion of the key 53 of the outer core portion 50 into the groove 45 in the inner core portion 40 restricts relative rotation in the circumferential direction. Consequently, the outer core portion 50 is mounted on the inner core portion 40 in a condition in which the outer core portion 50 is restricted from relatively moving in the axial direction and relatively rotating in the circumferential direction with respect to the inner core portion 40.

When the friction force between the sheet S and the rubber 70 is reduced as a result of repeated sequences of reading of the sheet S by the image reading apparatus 5, the rubber 70 is replaced with a new one to recover the friction force, which ensures conveying performance of the sheet S by the conveying device 1. The rubber 70 is replaced in this case by the following procedure: The outer core portion 50 on which the rubber 70 is mounted is removed from the inner core portion 40, and then the rubber 70 and the outer core portion 50 are replaced as one body.

When removing the outer core portion 50 mounted on the inner core portion 40 from the inner core portion 40, the outer tab portion 65 is touched from the side on which the assembly restricting protrusions 55 of the outer core portion 50 are disposed, and an outward force in the radial direction of the outer core portion 50 is applied to the engaging portion 66. This elastically deforms the outer tab portion 65 to move the engaging portion 66 outwardly in the radial direction. This movement of the engaging portion 66 causes the abutting surface of the outer tab portion 65 to become separated from the abutting surface of the inner tab portion 61. As a result, the outer tab portion 65 and the inner tab portion 61 are disengaged.

When the outer tab portion 65 and the inner tab portion 61 are disengaged, the outer tab portion 65 is no longer restricted by the inner tab portion 61 from moving toward the assembly restricting protrusions 55. Therefore, the outer tab portion 65 is capable of moving in the direction toward the assembly restricting protrusions 55. In other words, the outer core portion 50 is capable of moving toward the assembly restricting protrusions 55 relative to the inner core portion 40. Specifically, the outer core portion 50 can be moved in a direction in which the outer core portion 50 is removed from the inner core portion 40.

Until the outer core portion 50 is completely removed from the inner core portion 40, the key 53 and the outer tab portion 65 fit in the grooves 45 in the inner core portion 40. To remove the outer core portion 50 from the inner core portion 40, the outer core portion 50 is moved in the axial direction. In this case, too, the inner peripheral surface 51 of the outer core portion 50 is in contact with the outer peripheral surface 41 of the inner core portion 40 by way of only the protrusions 52. Thus, because of the small contact area involved, the friction force remains small, which permits easy movement in the axial direction. With the outer tab portion 65 elastically deformed as described above to thereby disengage the outer tab portion 65 and the inner tab portion 61, the outer core portion 50 is removed from the inner core portion 40.

When the rubber 70 is removed from the inner core portion 40 through the removal of the outer core portion 50 from the inner core portion 40, the outer core portion 50 on which a new rubber 70 is mounted is mounted on the inner core portion 40 by using the above-described procedure. Thus, the rubber 70 and the outer core portion 50 are replaced as one body. It is noted at this time that the two grooves 45 formed in the inner core portion 40 have an identical shape, and that the inner tab portion 61 is formed on each of the two grooves 45. To mount the outer core portion 50 on the inner core portion 40, therefore, the key 53 and the outer tab portion 65 may be fitted into one of the two grooves 45.

The pick roller 21 of the conveying device 1 includes the inner core portion 40 and the outer core portion 50 as individual elements separate from each other, to allow the outer core portion 50 to be removable relative to the inner core portion 40. The rubber 70 is mounted on the outer core portion 50. In order to replace the rubber 70, therefore, the rubber 70 and the outer core portion 50 can be replaced as one body. This eliminates improper mounting of the rubber 70 and enables easy replacement of the rubber 70.

The inner peripheral surface 51 of the outer core portion 50 has the protrusions 52. This can reduce the contact area between the inner peripheral surface 51 of the outer core portion 50 and the outer peripheral surface 41 of the inner core portion 40, thereby minimizing a friction force occurring therebetween. This facilitates removal of the outer core portion 50 relative to the inner core portion 40, thus permitting even easier replacement of the rubber 70.

The inner core portion 40 and the outer core portion 50 are arranged so that the engagement of the tab portions 60, which include the inner tab portion 61 and the outer tab portion 65, maintains the mounted condition of the outer core portion 50. The elastic deformation of the outer tab portion 65 disengages the inner tab portion 61 and the outer tab portion 65. Therefore, removal and reinstallation of the outer core portion 50 can be performed even more easily. As a result, the rubber 70 can be replaced with a new one even more easily.

In addition, the inner core portion 40 and the outer core portion 50 restrict relative rotation therebetween through the key 53 of the outer core portion 50 inserted into the groove 45 in the inner core portion 40 and relative movement in the axial direction through the engagement between the inner tab portion 61 and the outer tab portion 65. Accordingly, the outer core portion 50 can be mounted on the inner core portion 40 even more reliably. Furthermore, the inner core portion 40 has the two grooves 45 formed into an identical shape, each of which has the inner tab portion 61. Thus, the outer core portion 50 can be mounted on the inner core portion 40 even when the key 53 or the outer tab portion 65 is inserted into either of the grooves 45. As a result, the outer core portion 50 can be easily mounted on the inner core portion 40, and the rubber 70 can be replaced with a new one even more easily.

Modifications

In the pick roller 21 according to the embodiment described above, the protrusions 52 are formed on the inner peripheral surface 51 of the outer core portion 50. The protrusions 52 may nonetheless be formed on the outer peripheral surface 41 of the inner core portion 40. The protrusions 52 may be formed on at least one of the inner peripheral surface 51 of the outer core portion 50 and the outer peripheral surface 41 of the inner core portion 40 that face each other to be in contact with the other surface opposed thereto, when the outer core portion 50 is mounted on the outside of the inner core portion 40. By disposing the protrusions 52 that contact the opposed other surface as described above, the contact area between the inner peripheral surface 51 of the outer core portion 50 and the outer peripheral surface 41 of the inner core portion 40 can be reduced. Therefore, a friction force generated between the surfaces can be decreased, and the outer core portion 50 can be removed or reinstalled easily with a small force.

In the above-described embodiment, the inner core portion 40 is mounted on the rotational shaft 22 via the one-way clutch mechanism. The inner core portion 40 may otherwise be mounted on the rotational shaft 22. The inner core portion 40 may be mounted rotatably on the rotational shaft 22 or mounted as one body with the rotational shaft 22 to be rotatable therewith. The inner core portion 40 may be arranged in any manner as long as it is rotatably mounted on the rotational shaft 22.

In the above-described embodiment, the pick roller 21 is described as an exemplary feed roller that includes the outer core portion 50, on which the rubber 70 is mounted, to be mounted on or removed from the inner core portion 40. Such a feed roller may also be applied to any element other than the pick roller 21. The feed roller that includes the outer core portion 50 to be mounted on or removed from the inner core portion 40 may be applied, for example, to the brake roller 23, the conveying roller 26, or the discharging roller 27.

In the above-described embodiment, the image reading apparatus 5 on which the conveying device 1 is mounted is described. The conveying device 1 may nonetheless be mounted on any apparatus other than the image reading apparatus 5. For example, the conveying device 1 may be mounted on an automatic sheet feeding mechanism mounted on an image reading apparatus such as a scanner or a facsimile, or an image forming apparatus such as a printer.

The feed roller of a conveying device may be configured so as to combine as appropriate the arrangements of the above-described embodiment and the modifications, or incorporate any other arrangement that is not described above. Regardless of the arrangements of the feed roller of a conveying device, the outer core portion 50, on which the rubber 70 to be in contact with the sheet S is mounted, may be removably mounted to the inner core portion 40 disposed rotatably on the rotational shaft 22. This enables easy replacement of the rubber 70 without improper mounting.

The feed roller of a conveying device according to the embodiment of the present invention achieves an effect that enables easy replacement of a rubber without improper mounting.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A feed roller of a conveying device, comprising:

an inner core portion disposed rotatably on a rotational shaft;

a rubber in contact with a conveyed object;

an outer core portion on which the rubber is mounted and that is removably mounted on the outside of the inner core portion;

wherein an inner peripheral surface of the outer core portion includes an outer tab portion and an outer peripheral surface of the inner core portion includes an inner tab portion so as to form a pair of tab portions that are engaged with each other when the outer core portion and the inner core portion are in a predetermined fit condition; and wherein the outer tab portion has a support portion, which extends in a radial direction and is connected to the outer core portion, and an engaging portion, which is connected to the support portion, extends in the rotation axis direction, and engages with the inner tab portion of the inner core portion.

2. The feed roller of a conveying device according to claim 1, wherein at least one of the inner peripheral surface of the outer core portion and the outer peripheral surface of the inner core portion has a protrusion disposed thereon, the inner peripheral surface and the outer peripheral surface facing each other, the protrusion being in contact with the other peripheral surface opposed thereto when the outer core portion is mounted on the outside of the inner core portion, and a gap is provided between the inner peripheral surface of the outer core portion and the outer peripheral surface of the inner core portion in the condition that the protrusion is in contact with the other peripheral surface.

3. The feed roller of a conveying device according to claim 1, wherein the inner peripheral surface of the outer core portion includes a key that restricts rotation relative to the inner core portion, and wherein the outer peripheral surface of the inner core portion includes a first groove in which the key on the outer core portion fits and a second groove in which the inner tab portion is formed, the two grooves having an identical shape.

* * * * *